US005542862A

United States Patent [19]

Kobayashi

[11] Patent Number: 5,542,862

[45] Date of Patent: Aug. 6, 1996

[54] WATERCRAFT WITH PIVOT CONTROL

[75] Inventor: Noboru Kobayashi, Iwata, Japan

[73] Assignee: Yamaha Hatsudoki Kabushiki Kaisha, Iwata, Japan

[21] Appl. No.: 349,981

[22] Filed: Dec. 6, 1994

Related U.S. Application Data

[63] Continuation of Ser. No. 122,249, Sep. 16, 1993, abandoned.

[30] Foreign Application Priority Data

Sep. 16, 1992 [JP] Japan ..... 4-246510
Mar. 17, 1993 [JP] Japan ..... 5-57401

[51] Int. Cl.[6] ..... B63H 11/00

[52] U.S. Cl. ..... 440/38; 114/270; 114/144 R; 440/84

[58] Field of Search ..... 440/38, 39, 40, 440/41, 42, 43, 84; 114/270, 361, 362, 363, 364, 144 R

[56] References Cited

U.S. PATENT DOCUMENTS 4,893,579 1/1990 Kobayashi .
5,282,437 2/1994 Avillez de Basto .

FOREIGN PATENT DOCUMENTS 2172866 1/1985 United Kingdom .

*Primary Examiner*—Stephen Avila
*Attorney, Agent, or Firm*—Knobbe, Martens, Olson & Bear

[57] ABSTRACT

A number of embodiments of watercraft having generally opened passenger's areas that are closed on their sides by an upstanding wall and which incorporates a pivoted control mast that has a portion carrying one or more watercraft propulsion unit controls for operation of the watercraft by either a standing or seated rider within the rider's area. Various types of seating arrangements are disclosed and in some embodiments, the seats are foldable between a lowered, horizontal position and a position wherein a seatback is provided. Alternate cover arrangements are also provided for covering the control mast when in its lowered position.

22 Claims, 13 Drawing Sheets

WATERCRAFT WITH PIVOT CONTROL

This application is a continuation of application Ser. No. 08/122,249, filed Sep. 16, 1993, now abandoned.

BACKGROUND OF THE INVENTION

This invention relates to a watercraft and more particularly to a watercraft with an improved control.

There is a general class of small watercraft that are designed to be operated by a rider primarily in a standing fashion on a deck to the rear of the watercraft and which is generally open. The control for this watercraft is normally provided at one end of a mast that is pivotally supported at the forward end of the watercraft so that it will go to a lowered position when not in use. The rider may also control the watercraft from a crouching or kneeling position on the deck in addition to the standing position. The use of this type of control has been generally limited to watercraft of the type described.

More conventional watercraft in which the passengers compartment is generally enclosed on at least the sides embody conventional types of control such as steering wheels that are mounted in a fixed position in front of an operators section. For the most part, these types of controls are satisfactory.

However, there are times when it is desirable to permit the operator to control the watercraft either from a seated position, during normal watercraft operation, or from a standing position for example when operating at low speeds, such as dummy docking or the like. Conventional watercraft controls employed with respect to conventional watercraft normally do not accommodate these two purposes.

It is, therefor, a principle object of this invention to provide an improved watercraft control for a type of watercraft having at least a partially enclosed operators area and wherein the operator may operate the watercraft either from a standing or seated position.

It is a further object of this invention to provide an improved watercraft control for a watercraft that includes a pivoted mast type of control.

SUMMARY OF THE INVENTION

This invention is adapted to be embodied in a watercraft and control comprised of a hull defining a riders area that is bounded on the sides by an upstanding wall. A propulsion unit is provided for propelling the watercraft. A control mast is supported for pivotal movement about a fixed horizontal axis between a lowered position and a raised position. At least one propulsion unit control is carried by the control mast for controlling the propulsion unit. The propulsion unit control is positioned on the mast so that an operator may operate the watercraft either from a seated position in the riders area or a standing position in the riders area.

DETAILED DESCRIPTION OF THE PREFERRED EMBODIMENTS OF THE INVENTION

Figure 1:
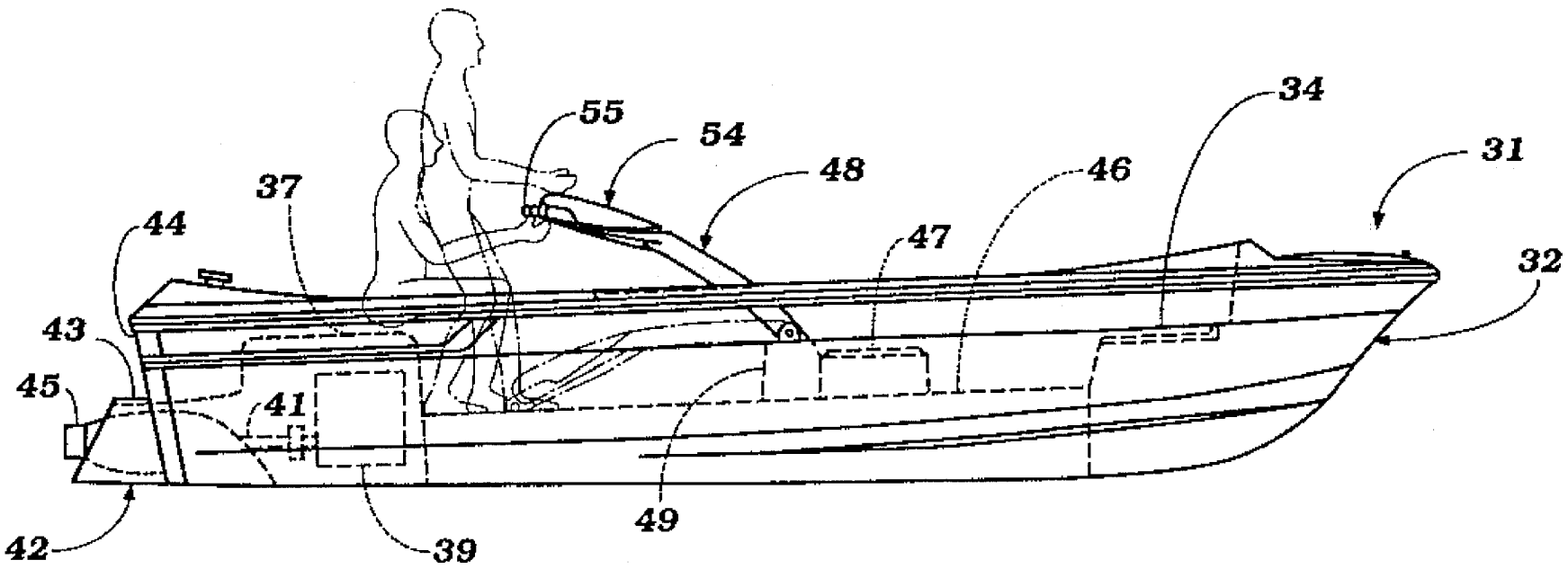
FIG. 1 is a side elevational view of a watercraft constructed in accordance with a first embodiment of the invention and shows a rider operating the watercraft either from a standing or seated position and shows also how the control may be lowered for a storage position in a phantom line view.
Figure 2:
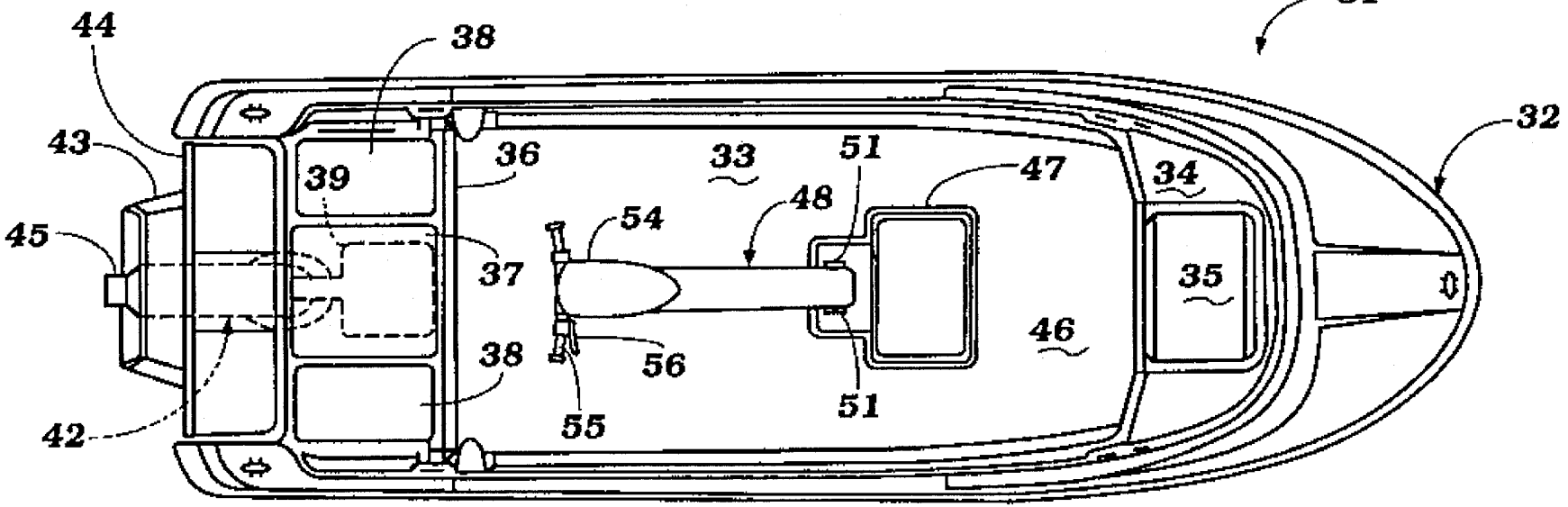
FIG. 2 is a top plan view of the watercraft shown in FIG. 1.
Figure 3:
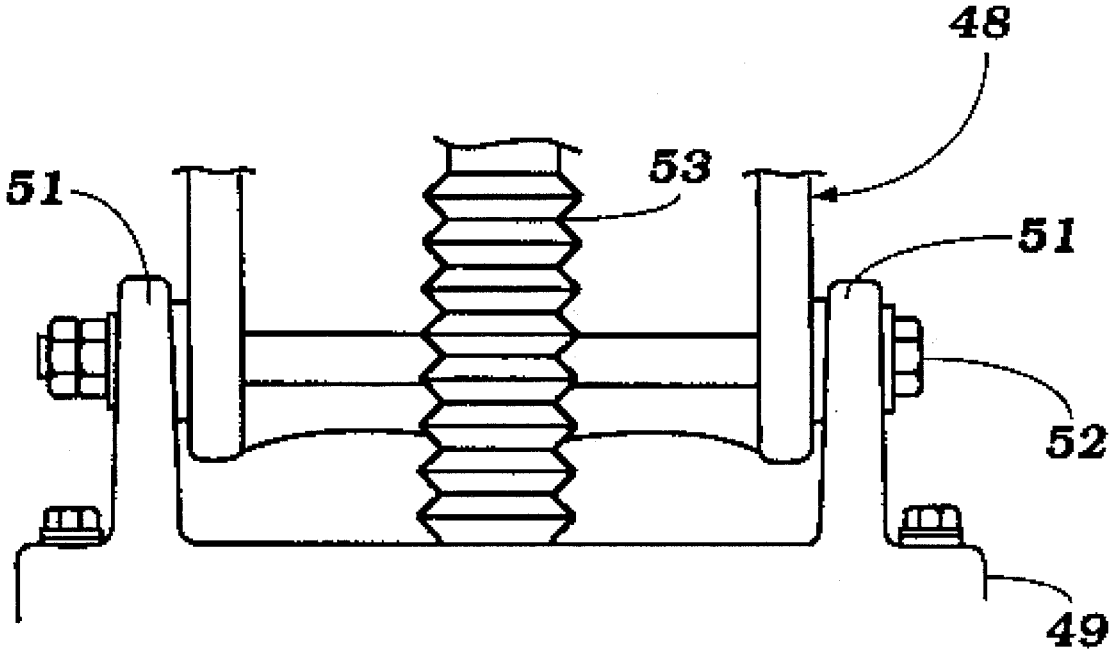
FIG. 3 is a rear elevational view showing the pivotal support for the control mast.

Referring now in detail to the drawings and initially to the embodiment of FIGS. 1–3, a watercraft constructed in accordance with this embodiment of the invention is identified generally by the reference numeral 31. The watercraft 31 is comprised of a hull, indicated generally by the reference numeral 32 which may be formed from any suitable material such as a molded fiberglass reinforced resin or the like and which defines a generally upwardly open passengers area 33 rearwardly of the bow and which extends between transversely spaced apart side walls, a front wall and the transom of the watercraft so as to be completely enclosed on the sides but open on the top as clearly seen in FIGS. 1 and 2.

The forward portion of the hull 32 is provided with a step area 34 which is at the forward end of the passengers compartment 33 and which has a removable hatch cover 35 to afford access to a storage area that may be positioned therebeneath.

In this embodiment, the rear of the passengers compartment 33 is provided with a raised area 36 on which are positioned a central seat 37 and a pair of side seats 38. Beneath this raised area 36 is an engine compartment in which an internal combustion engine of any known type and which is shown in phantom and identified by the reference numeral 39 is positioned. The engine 39 has its output shaft coupled to an impeller shaft 41 of a jet propulsion unit, indicated generally by the reference numeral 42 and which has a portion of the assembly extending through an extension 43 formed at the rear end of the transom 44 of the watercraft 31. The jet propulsion unit, as is typical with this type of unit, draws water through a downwardly facing water inlet and discharges it rearwardly through a pivotally supported steering nozzle 45 for propelling the watercraft 31 and for permitting its steering, in a manner which will be described.

As may be best seem in FIGS. 1 and 2, the forward portion of the passengers area 33 is generally unobstructed and has lower floor area 46 that extends rearwardly from the step 34, which step may also function as a seat. Mounted within this area is a forward storage box 47 which may provide a storage compartment that is accessible through a removable hatch cover and a control mast assembly, indicated generally by the reference numeral 48.

The control mast assembly 48 is mounted on a mounting pedestal 49 by an assembly that is shown additionally in FIG. 3 and which includes a pair of upwardly extending bosses that receive a pivot bolt assembly 52 that extends in a generally horizontal direction and which basically fixed. The pivot bolt 52 journals the lower end of the control mast 48 for pivotal movement between a fully lowered positioned as shown in the phantom line position of FIG. 1 wherein it will rest on the floor 46, and an one or more elevated operating positions. A spring assembly, may be provided for normally biasing the handle 48 to an upward position. The bias is such, however, that the mast will not be automatically elevated by the spring mechanism but rather will merely assist in the operators raising it from the storage position to an elevated operative position as shown in FIG. 1 in solid line views.

A control assembly, indicated generally by the reference numeral 54 is provided at the upper end of the mast 48 and this includes a handle bar assembly 55 which is coupled by any suitable mechanism (not shown) such as a bowden wire cable or the like to the steering nozzle 45 for its steering. In addition, a throttle control 56 is carried at one end of the handle bar 55 and is coupled to the throttle control of the engine 39, again in any suitable manner such as by a bowden wire, for control of the speed of the engine.

As may be seen in the figures., the mast assembly 48 may be pivoted from its lowered position to an elevated position wherein an operator, shown in phantom in FIG. 1, may steer the watercraft when seated on the cushion 37. In addition, the operator may stand in position as shown in FIG. 1 and may further raise the control mast 45 so as to permit standing control of the watercraft. This advantageous when traveling at low speeds and performing such maneuvers as docking or moving away from the dock or when maneuvering into any position. For long range cruising and operation, however, operation from the seated position is preferable although either operation is possible as aforedescribed.

The aforenoted flexible cables that extend from the control portion 54 to the steering nozzle 45 and throttle the engine 39 may be encircled in a protective boot 53 as shown in FIG. 3 where they pass through the base of the control mast 48 and enter the base 49. In addition, any other type of controls as may be required such as kill switches or the like may be mounted on the control portion 54 for controlling other functions of operation of the watercraft 31.

Figure 4:
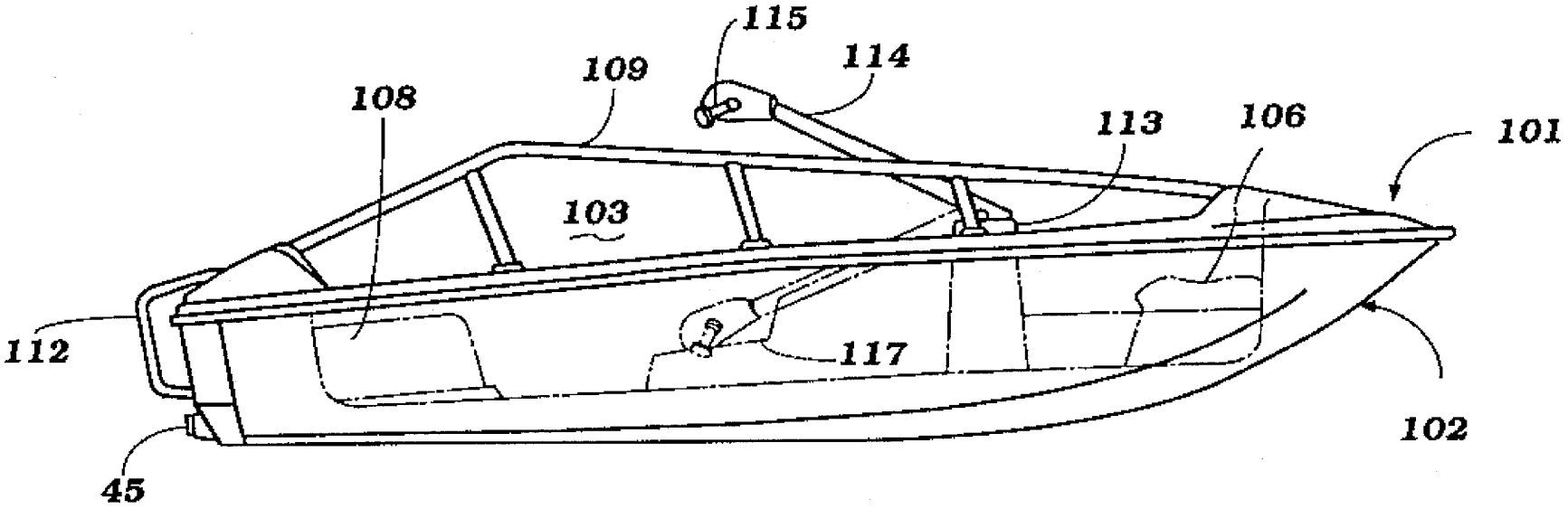
FIG. 4 is a side elevational view, in part similar to FIG. 1, and shows another watercraft having a control constructed in accordance with an embodiment of this invention.
Figure 5:
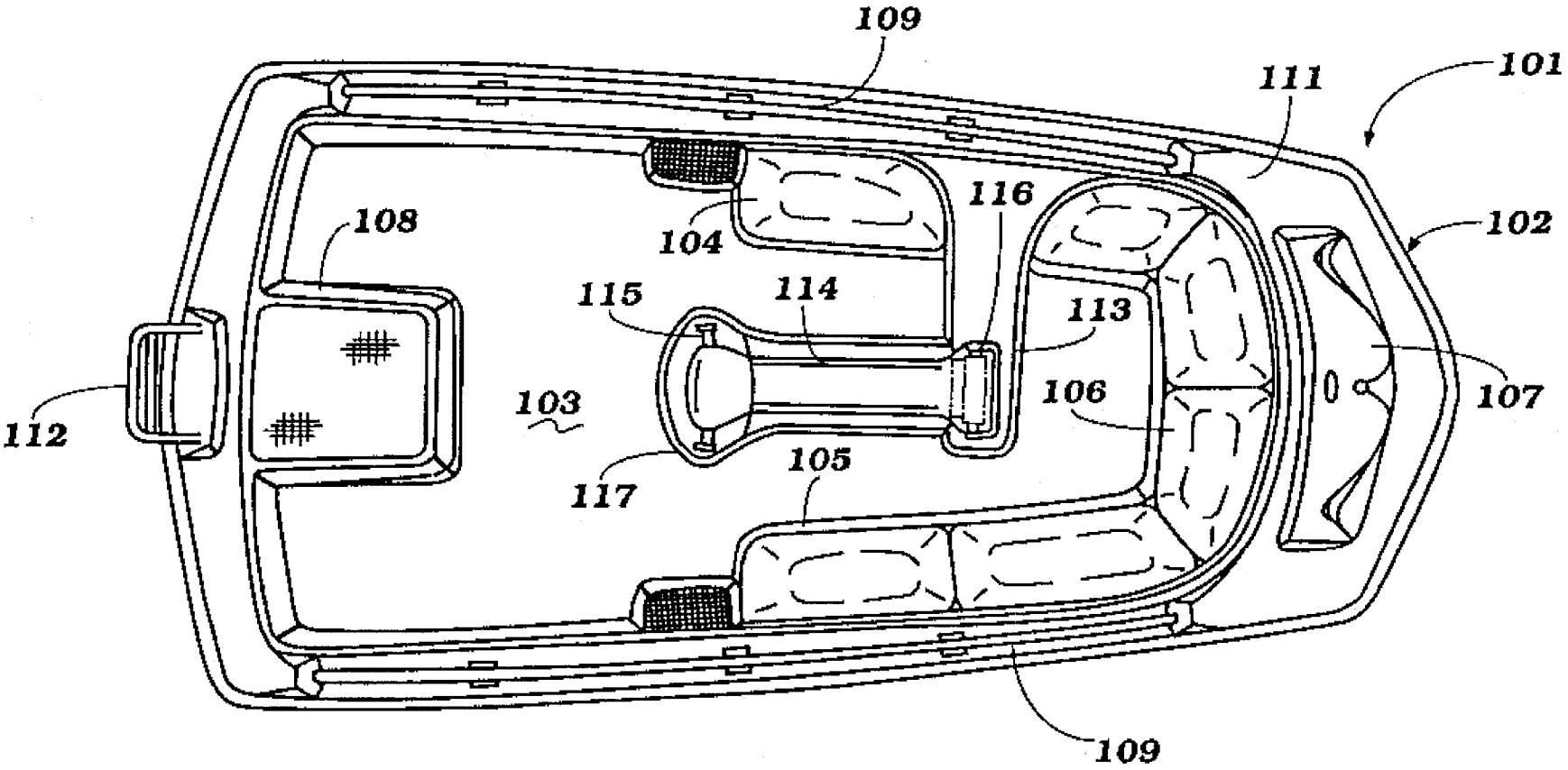
FIG. 5 is a top plan view of the watercraft of this embodiment.

A watercraft constructed in accordance with a second embodiment of the invention is depicted in FIGS. 4 and 5 and is identified generally by the reference numeral 101. Certain details of the watercraft 101, some of which will be described, may be the same as that of the watercraft 31 of the embodiment of FIGS. 1–3. Where that is the case, these components if illustrated, will be identified by the same reference numeral. Basically, this embodiments differs from the previously described embodiment primarily in the configuration of the passengers area of the watercraft 101 and the shape of its hull, which hull is indicated generally by the reference numeral 102 and, like that of the previously described embodiment, may be formed from any suitable material such as a molded fiberglass reinforced resin or the like.

The hull 102 defines a generally open top riders area 103 which provides a U-shaped seating assembly consisting of side portions 104 and 105 and a front portion-106 that spans the forward end of the passengers area 103 and forms and extension of the seat side portions 104 and 105. A storage area may be provided in the hull 102 forwardly of the seat 106 and this is accessible through an openable hatch cover 107.

At the rear of the hull there is provided an engine compartment 108 which extends in part into the passengers area 103 and which contains an engine and jet propulsion unit as with the previously described embodiment. Because of this similarity and construction, the engine and jet propulsion unit, both of which may be of any conventional and well known type, are not illustrated nor is further description of them believed to be necessary.

The passengers area 103 is bounded by a grab rail 109 at the sides and which merges to a deck 111 at the front in which the hatch cover 107 is positioned. At the rear, a boarding ladder 112 is provided so as to permit entry of the watercraft 101 from the body of water in which the watercraft is operating. The boarding ladder 112 is positioned so that it will not interfere with the operation of the jet propulsion unit and specifically so that it will obstruct the discharge and/or steering nozzle 45.

The hull 102 is provided with a raised partition portion 113 that extends between portions of the side seat 104 and terminates centrally of the passengers compartment 103 forwardly of the engine cover 108. A pivotally supported mast 114 which carries a handle bar assembly 115 is carried by the portion 103 by an upstanding bracket 116 which may be substantially the same as the bracket assembly 51 of the previously described embodiment. The mast assembly 114 may be pivoted between a lowered position as shown in phantom lines in FIG. 4 where it will lie across a rearwardly extending projection 117 of the hull projection 113 so as to be out of the way for storage purposes. Also, the mast may be elevated to a partially raised position so as to afford operation by a rider that may sit on the engine cover 108 or a fully elevated position as shown in the solid line view of FIG. 4 so as to be operated by a standing rider when traveling at low speeds. A biasing spring assembly may be provided to assist in the mount. As with the previously described embodiment, the handle bar assembly 114 may be connected through a bowden wire cable (not shown) to the steering nozzle 45 for steering of it. In addition, any known type of throttle assembly such as a twist type throttle or a handle grip type throttle as shown in FIGS. 1–3 may be employed for controlling the speed of the engine in a well known manner.

In the embodiments of the invention as thus far described, the pivot support for the control mast for the watercraft has been placed actually in the passengers compartment. FIG. 6–9 show another embodiment of the invention which shows how the control mast may be pivoted at a position outside of the riders area but still afford control for the watercraft from either a sitting or standing position within the passengers compartment of the watercraft. In this embodiment, the watercraft is identified generally by the reference numeral 151 and has a hull configuration which is different from those of the previously described embodiments although like those embodiments it has a hull 152 which may be formed from a molded fiberglass reinforced resin or the like and which has a generally V-shaped bottom so as to provide a planing type of hull.

In this embodiment, the hull 152 has a forward deck 153 that extends generally rearwardly toward a forward passengers compartment 154. This forward deck 153 has a raised portion 155 that provides a smooth streamlined configuration and which also provides a concealed, internal, horizontally extending pivot axis (not shown) for a control mast indicated generally by the reference numeral 156 which control mast extends rearwardly into the forward most passengers compartment 154. The pivot support for the mast 156 may be of the type shown in the previously described embodiments including a biasing spring but in this case is positioned on the deck 153 within the recess 155 forwardly of passengers area 154.

As with the previously described embodiments, the mast 156 carries a handle bar assembly 157 for steering of the watercraft and a throttle control 158 of the hand grip type. These controls 157 and 158 are connected to the propulsion unit by bowden wire cables and the propulsion unit will be described later.

At the rear portion of the forward passengers area 154 there are provided three seat cushion which form a bench type seat 159 with a center most cushion 161 that is removable so as to access an engine 162 that is positioned within an engine compartment 163 formed beneath the center seat cushion 161.

The engine 162 has a throttle control that is coupled to the speed control lever 158 by means of a bowden wire cable for watercraft speed control.

A jet propulsion unit, indicated generally at 164 and which may be of any known type, is positioned in a tunnel 165 formed at the rear portion of the hull 152 and beneath a rearward passengers area 166. The front passengers area 154 and rear passengers area 166 are divided by a vertical wall 167 which also forms a back rest for the seats 159 and 161.

The jet propulsion unit 164 has a steering nozzle 168 which is coupled to the handle bar assembly 157 by a bowden wire actuator for steering control, as should be apparent from the foregoing descriptions. In addition, a reverse thrust bucket 169 may be positioned for effecting reverse operation and can be controlled in any suitable manner, as by a control also carried by mast 156 in proximity to the controls 157 and 158.

Figure 6:
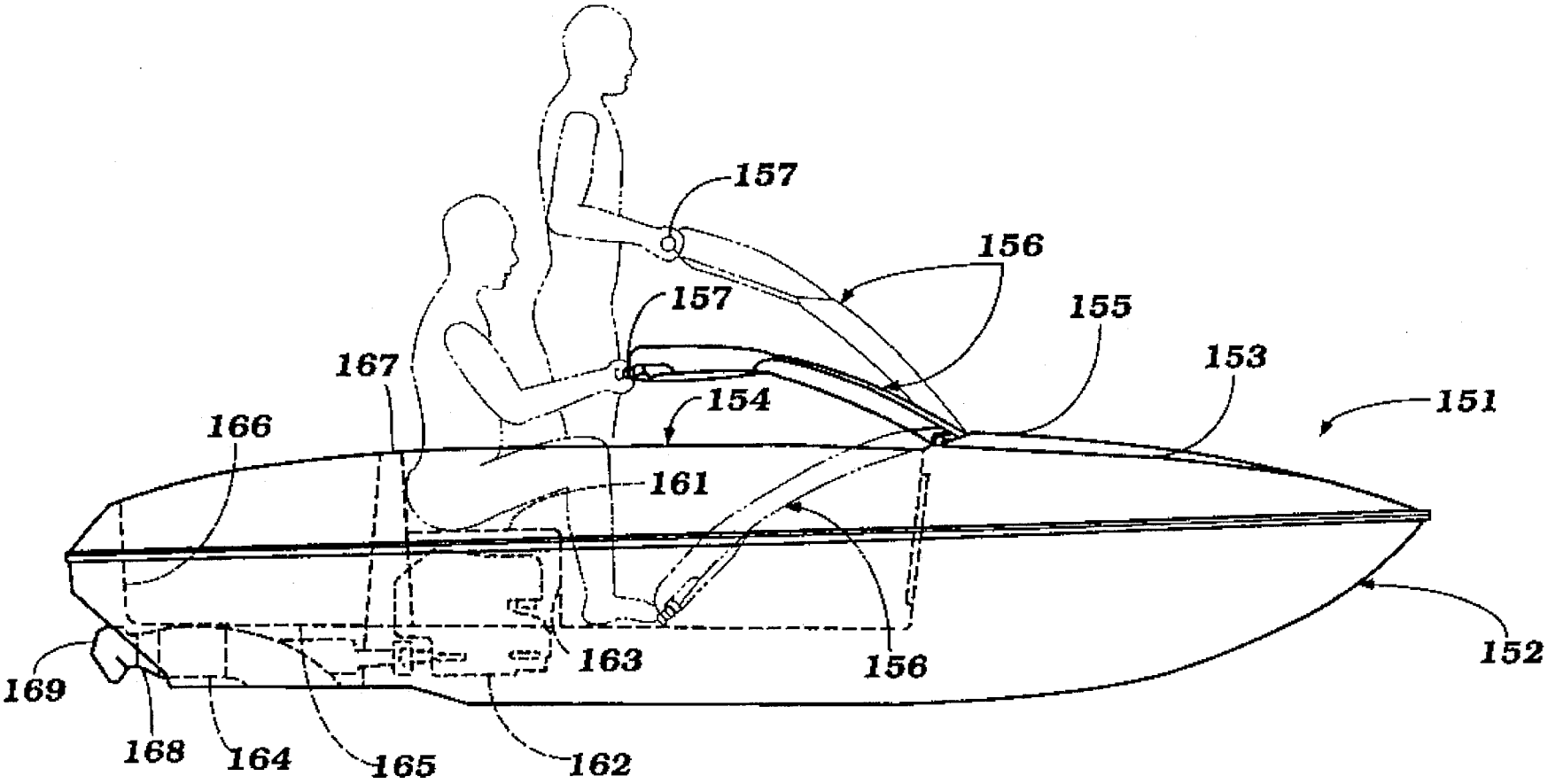
FIG. 6 is a side elevational view, in part similar to FIGS. 1 and 4 showing another embodiment of the invention. In this embodiment, the control is shown in a solid line position for operation by a seated rider, and in phantom line positions for operation by a standing rider or in a storage position.
Figure 7:
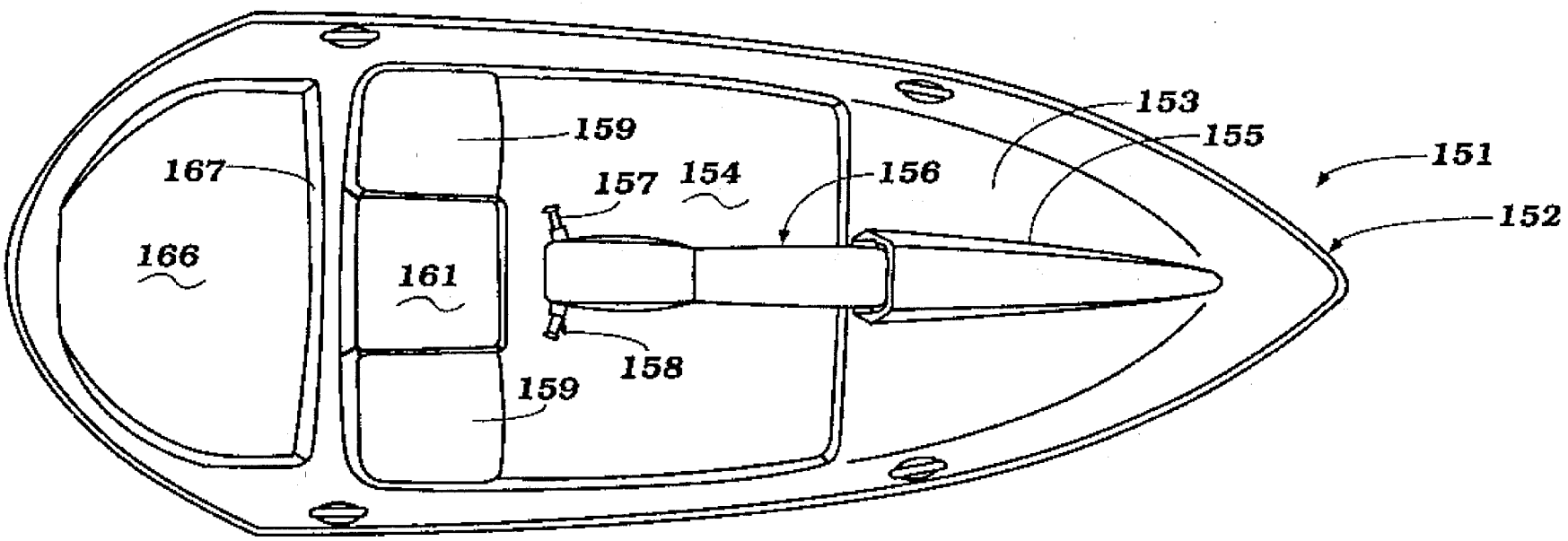
FIG. 7 is a top plan view of this embodiment.
Figure 8:
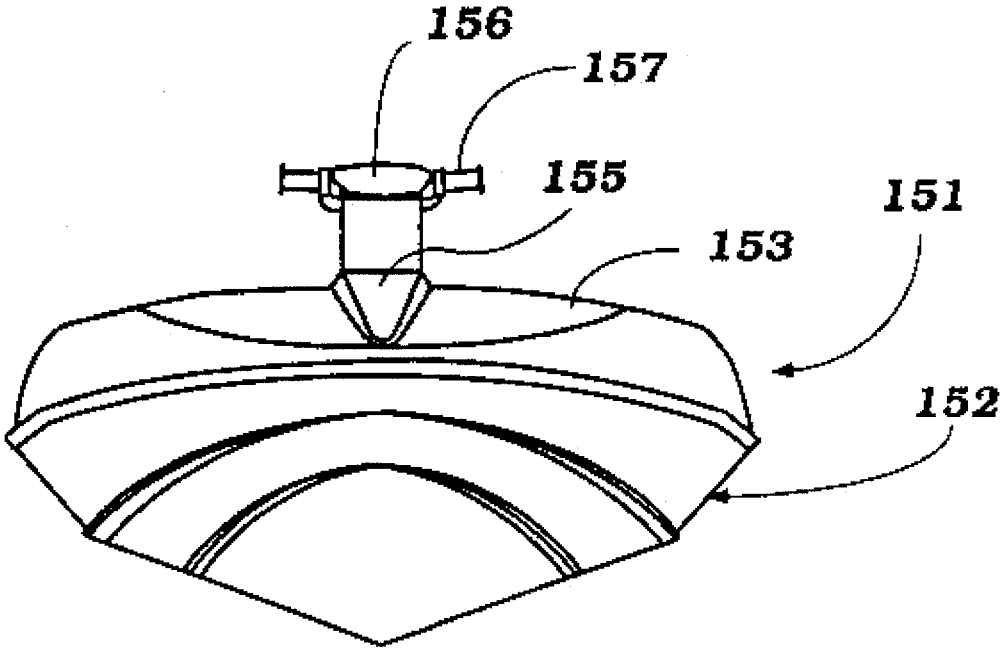
FIG. 8 is a front elevational view.
Figure 9:
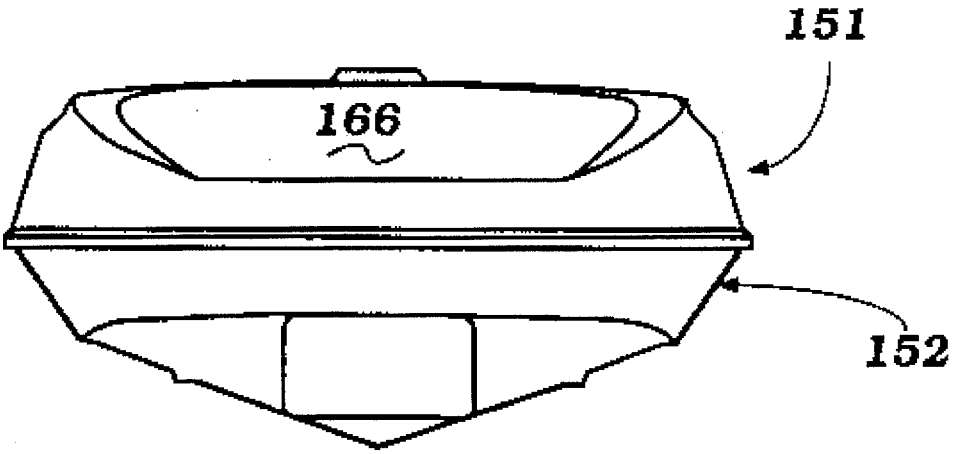
FIG. 9 is a rear elevational view.

As may be readily apparent from FIG. 6, the mast 156 may pivotal between a fully raised position as shown in solid lines in FIG. 6 wherein a standing operator may operate the watercraft 151, a partially lowered position, as also shown in solid lines, wherein a seated operator may control the watercraft or a lowered position, as shown in phantom lines wherein the control and mast 156 will be out of the way to afford access to the passengers compartment 154.

A watercraft constructed in accordance with another embodiment of the invention is identified generally by the reference numeral 201 and is shown in the remaining figures (FIGS. 10–18). Aside from some differences in the configuration of the passengers compartment and the seating arrangement therefor, this embodiment is generally the same as the previously described embodiments. However, this embodiment also differs from the earlier embodiments described and illustrated in that a removable cover is provided for concealing the control mast when it is in its lowered storage position. It is to be understood that this embodiment may be employed without such a cover. Also, as will be readily apparent to those skilled in the art, all of the previously described embodiments may also employ such a type of removable cover for covering there respective control mast 48, 114 or 156 when in their lowered storage positions.

In this embodiment, the watercraft 201, like the previously described embodiments, is comprised of a hull 202 which may be formed from a suitable material such as a molded fiberglass reinforced plastic or the like. The hull 202 has a forward deck 203 which may provide beneath it a storage compartment that is accessible through a removable hatch 204.

Rearwardly of the deck 203, the hull 202 is provided with a passengers area 205. A pair of side seats, indicated generally by the reference numeral 206 are disposed at opposite sites of the passengers area 205 and are comprised of four interconnected cushions 207, 208, 209 and 211. As may be seen in FIG. 15, the cushions 207, 208, 209 and 211 are constructed and interconnected in such a way that they may be moved between a horizontally disposed position as shown in FIG. 16 wherein the cushions 207, 208, 209 and 211 are all disposed in the same horizontal plane and may either accommodate a rider in a lying position, riders seated with their legs crossed or depending into the area of the passengers compartment 205 between the side seats 206.

Figure 15:
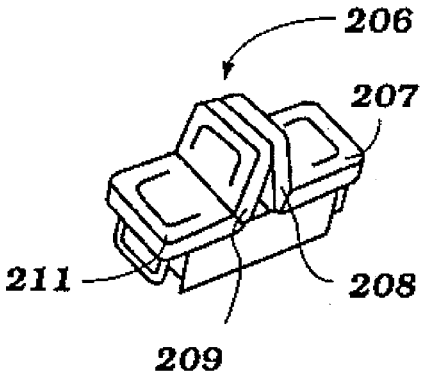
FIG. 15 is a perspective view showing the side seats folded into one position.
Figure 16:
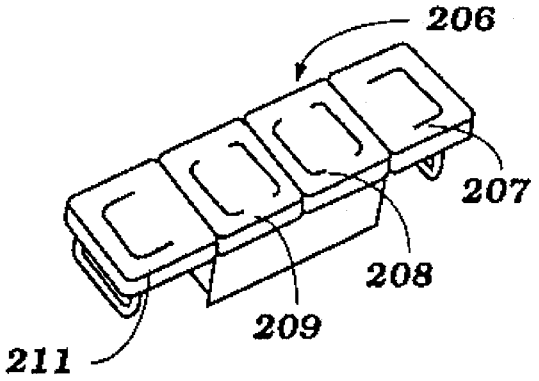
FIG. 16 is a perspective view, in part similar to FIG. 15, showing the side seat in another position.
Figure 17:
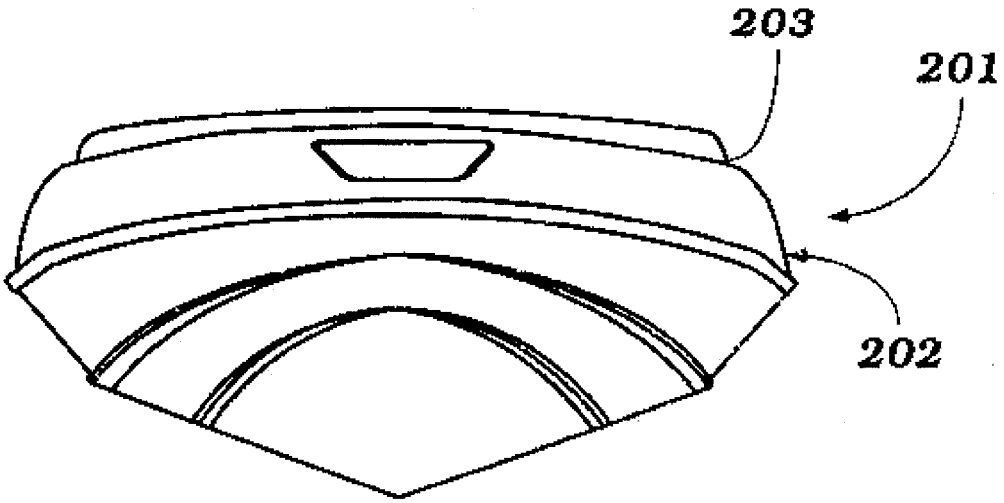
FIG. 17 is a front elevational view of this embodiment.
Figure 18:
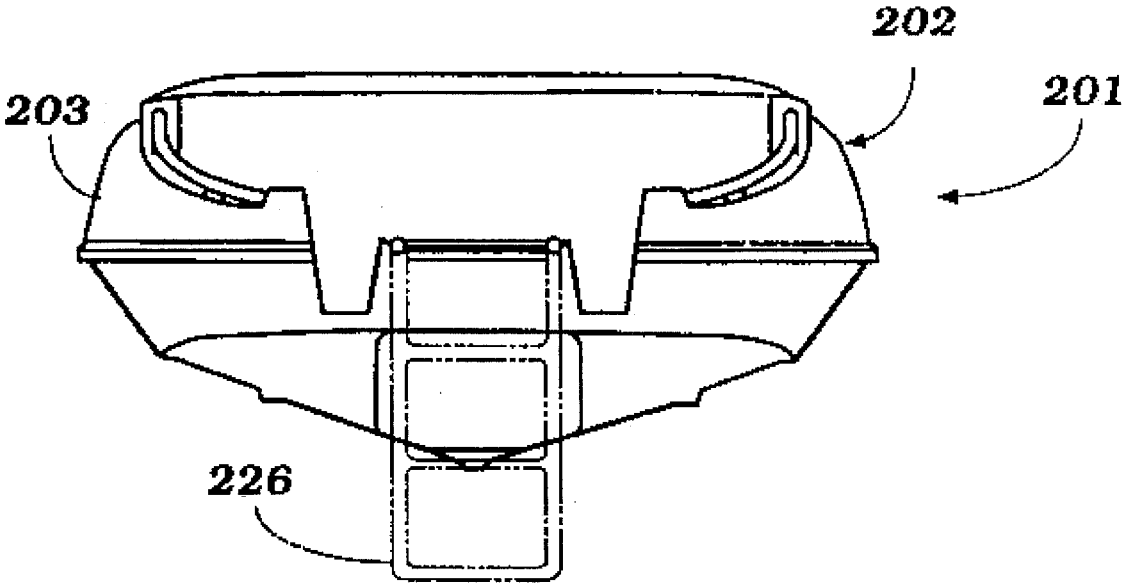
FIG. 18 is a rear elevational view.

In addition, the cushions 208 and 209 may be slid upwardly as shown in FIG. 15 to form seat backs for the cushions 207 and 211 so as to accommodate two riders at either side of the riders area, one face forwardly and one facing rearwardly on the respective side seat 206.

Between the rearmost seat cushions 211, when in their lowered position, there is provided an engine cover 212 which covers an internal combustion engine 213 which powers the watercraft 201 in a manner to be described. A rider or operator may sit on the engine cover 212 and a seat cushion may be provided on the cover 212 so as to accommodate a rider.

A control mast assembly indicated generally by the reference numeral 214 is pivotally supported at the front of the riders area 205 on an upstanding bracket 215 in a manner similar to the embodiment of FIGS. 1–3. Like that embodiment, the mast 214 may be spring biased and carries a handle bar assembly 216 for steering of the discharge nozzle of the jet propulsion unit, to be described, and a throttle control (not shown) for controlling the speed of the engine 213. Various other controls may also be incorporated on the control mast 214.

Figure 10:
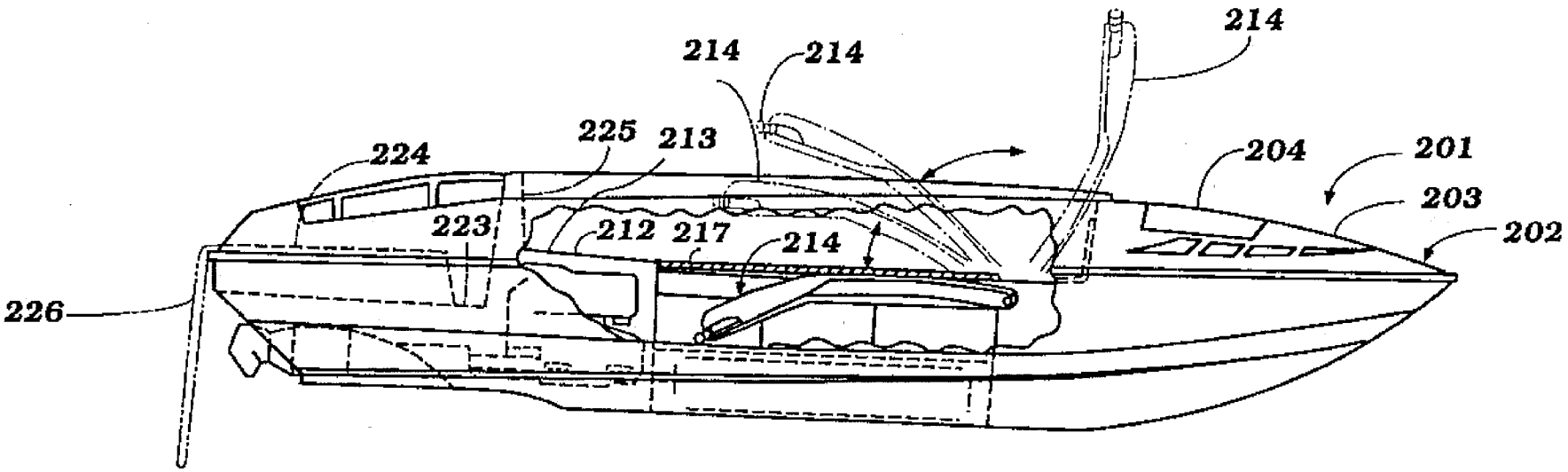
FIG. 10 is side elevational view, in part similar to FIGS. 1, 4 and 6 and shows yet another embodiment of the invention with portions broken away and shown in section and the operating mast in a number of different positions.
Figure 11:
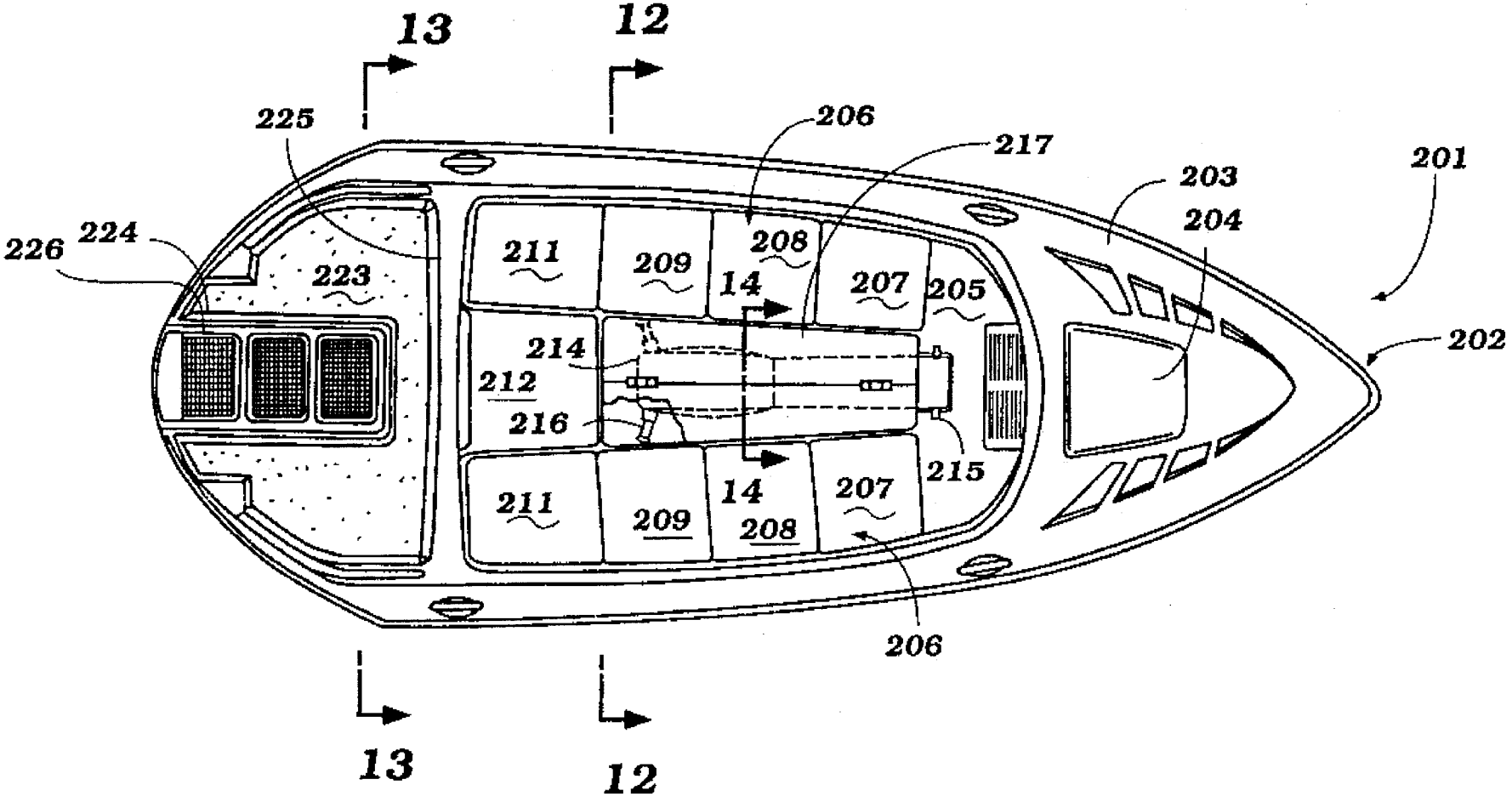
FIG. 11 is a top plan view of this embodiment, showing the mast in a storage and covered position.
Figure 12:
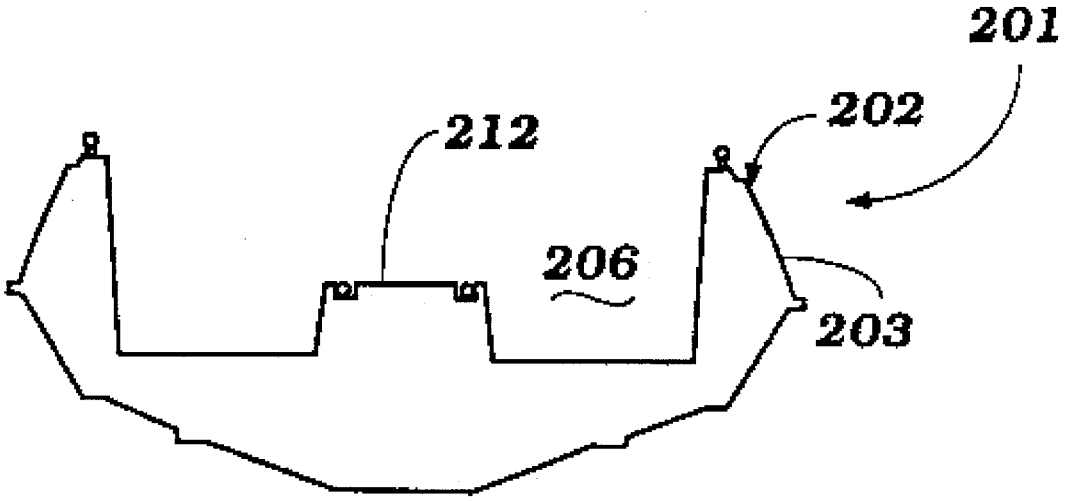
FIG. 12 is a cross-sectional view taken along the line 12—12 of FIG. 11.
Figure 13:
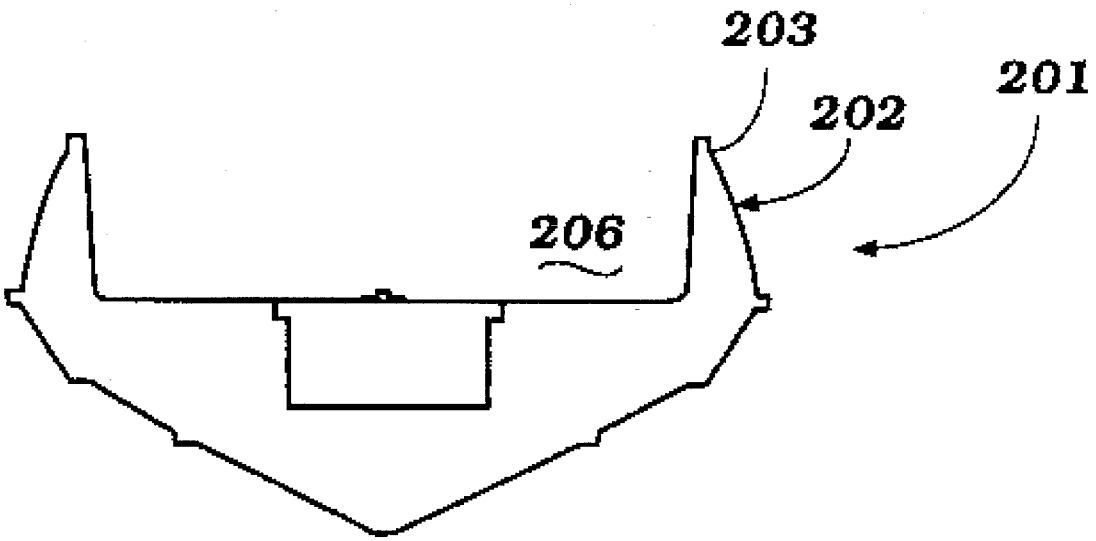
FIG. 13 is a cross-sectional view taken along the line 13—13 of FIG. 11.
Figure 14:
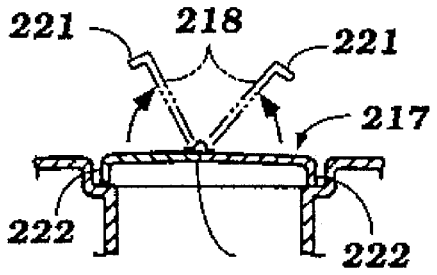
FIG. 14 is a cross-sectional view showing how the mast cover can be folded for removal and is taken generally along the line 14—14 of FIG. 11.

In this embodiment, the control mast 214 may be moved between a fully forward position as shown in FIG. 10 wherein a rider may operate the watercraft from a standing position at the front of the watercraft or where the mast 214 may be moved clear of the major portion of the riders area 215 for entry and other activities. The mast 214 may be also swung to a rearward control position where an operator may control the watercraft in a standing position as shown in the second phantom line view of FIG. 10 or a lowered control position as shown in the third phantom line view of FIG. 10 wherein an operator sitting on the engine cover 212 may control the watercraft 201 from a seated position. Alternatively, the mast 214 may be fully lowered as shown in the solid line view of FIG. 10 and in FIG. 11.

In this lowered position, a cover assembly, indicated generally by the reference numeral 217 may be positioned over the lowered mast 214 so as to provide a flush area within the passengers compartment 205. The cover 217 is comprised of a pair of side portions 218 having a hinged connection 219 so as to be folded up for ease of storage when not in use. The side portions 218 have downwardly extending lips 221 to be received on ledges 222 formed on the respective side seats 206 so as to provide a neat assembly when folded into its operative position as clearly shown in the solid line view of FIG. 14.

Rearwardly of the riders area 205 there is provided a rear deck area 223 that has a raised central portion 224. This rear deck area 223 is separated from the riders area 205 by a raised wall 225 which may form a back rest for a rider seated on the engine cover 212. The raised portion 214 has a recess in its upper surface which is complimentary in shape to a boarding ladder 226 so that the boarding ladder may be position in the condition as shown in FIG. 10 so that a rider may enter the rear deck 213 from the body of water in which the watercraft is operating.

From the foregoing description it should be readily apparent to those skilled in the art that the described embodiments provide a very effective control for a watercraft that permits the watercraft to be operated from a plurality of operator positions either kneeling, sitting or standing. Also, the control mast may be conveniently pivoted out of the way when not in use and may, in some embodiments, be covered when in this storage position so as to afford protection and further utility for the interior of the watercraft. Of course, the foregoing description is that of preferred embodiments and various changes and modification may be made without departing from the spirit and scope of the invention, as defined by the appended claims.

I claim:

1. A watercraft and control comprised of a hull defining a rider's area comprising a deck bounded on all sides by a wall upstanding from said deck so that said deck is disposed substantially below the upper portion of said hull, a seat disposed above said deck in said rider's area with the cushion disposed substantially below said upper portion of said hull, a propulsion unit for powering said watercraft, a control mast supported for pivotal movement about a fixed horizontal axis between a lowered position and a raised position, and at least one unit control carried by said control mast remotely from said fixed horizontal axis for controlling said propulsion unit, the distance between said unit control and said fixed horizontal axis being less than the distance between said seat and said fixed horizontal axis so that said propulsion unit control is positioned so that an operator may operate said watercraft either from a seated position in said rider's area or a standing position on said deck in said rider's area and so that said control mast may be lowered to a position below the upper portion of said hull without interference with said seat, even if an operator is seated thereon.

2. A watercraft and control as set forth in claim 1 wherein the control mast is pivotal to a position in engagement with the deck.

3. A watercraft and control as set forth in claim 2 further including a removable cover for covering the control mast when in its fully lowered position.

4. A watercraft and control as set forth in claim 1 wherein the pivot axis for the control mast is disposed within the rider's area.

5. A watercraft and control as set forth in claim 4 wherein the pivot axis is disposed rearwardly of the forward end of the rider's area.

6. A watercraft and control as set forth in claim 5 wherein the control mast is pivotal to a position in engagement with the deck.

7. A watercraft and control as set forth in claim 6 further including a removable cover for covering the control mast when in its fully lowered position.

8. A watercraft and control as set forth in claim 5 further comprising a pair of side seats disposed on opposite sides of the first mentioned seat.

9. A watercraft and control as set forth in claim 8 wherein the side seats are foldable between a horizontal position for accommodating lying or seated riders and a raised position wherein a portion of the seat forms a seat back for accommodating a seated rider.

10. A watercraft and control as set forth in claim 9 wherein the side seat in its horizontal position forms an extension of an area of the rider's area elevated above the deck and upon which the mast control is supported.

11. A watercraft and control as set forth in claim 10 wherein the control mast is pivotal to a position in engagement with the deck.

12. A watercraft and control as set forth in claim 11 further including a removable cover for covering the control mast when in its fully lowered position.

13. A watercraft and control as set forth in claim 12 wherein the cover is flush with the side seats in place and when the sears are in their horizontal position.

14. A watercraft and control as set forth in claim 5 wherein the seat is positioned at the rear of the rider's area and on which a seated rider may access the propulsion unit control.

15. A watercraft and control as set forth in claim 14 further including a pair of side seats in the rider's area extending along the sides thereof.

16. A watercraft and control as set forth in claim 15 wherein the side seats are connected to a cross front seat at the front of the rider's area.

17. A watercraft and control as set forth in claim 16 wherein the support for the control mast is formed by a projection extending outwardly toward the center of the rider's area from one of the side seats.

18. A watercraft and control as set forth in claim 1 wherein the pivot axis for the control mast is disposed at the forward end of the rider's compartment.

19. A watercraft and control as set forth in claim 18 wherein the pivot axis for the control mast is disposed forwardly of the rider's area on a forward deck portion of the hull raised relative to the rider's area deck.

20. A watercraft and control as set forth in claim 19 wherein the control mast is pivotal to a position in engagement with the rider's area deck.

21. A watercraft and control as set forth in claim 1 wherein the propulsion unit comprises a jet propulsion unit having a pivotally supported steering nozzle and wherein the propulsion unit control effects steering of the steering nozzle.

22. A watercraft and control as set forth in claim 1 wherein the horizontal axis of the control mast is spaced forwardly of the seat a sufficient distance so that a rider may operate the control either seated on the seat or standing in front of the seat.

* * * * *